United States Patent [19]

Olofsson

[11] 3,938,915

[45] Feb. 17, 1976

[54] SCREW ROTOR MACHINE WITH HOLLOW THREAD ROTOR ENCLOSING A SCREW CAM ROTOR

[75] Inventor: Hans Kristoffer Olofsson, Huddinge, Sweden

[73] Assignee: Atlas Copco Aktiebolag, Huddinge, Sweden

[22] Filed: July 18, 1974

[21] Appl. No.: 489,940

[30] Foreign Application Priority Data

July 20, 1973 Sweden ..... 7310167

[52] U.S. Cl. ..... 418/9; 418/91; 418/97; 418/166; 418/201

[51] Int. Cl.[2] ..... F01C 1/16; F04C 17/12

[58] Field of Search ..... 418/9, 48, 55, 91, 94, 418/97–100, 164, 166, 201, 220

[56] References Cited

UNITED STATES PATENTS

| | | | |
|---|---|---|---|
| 1,892,217 | 12/1932 | Moineau | 74/458 |
| 2,358,721 | 9/1944 | Ljungdahl | 418/100 |
| 2,553,548 | 5/1951 | Canazzi | 418/48 |
| 2,695,694 | 11/1954 | Seinfeld | 418/91 |

FOREIGN PATENTS OR APPLICATIONS

| | | | |
|---|---|---|---|
| 427,475 | 4/1935 | United Kingdom | 418/48 |

*Primary Examiner*—John J. Vrablik
*Attorney, Agent, or Firm*—Eric Y. Munson

[57] ABSTRACT

A screw rotor machine is disclosed which comprises a screw cam rotor provided with gudgeons and a screw thread rotor enclosing the screw cam rotor. The screw cam rotor is made as single-thread-screw which is generated in relation to an inner base cylinder. The profile of the single-thread-screw is such that it in each cross section encloses both the inner base cylinder and the cylindrical extensions of the gudgeons. Furthermore the single-thread-screw comprises two parts having different lead angles.

9 Claims, 18 Drawing Figures

0°

180°

360°

540°

720°

$V_1$
$V_2$
$V_3$
$V_4$
57
56
61(63)
60(62)
62(64)
61
62
0° (720°)
180°

V3
61
57
63
56
360°
V2

56
57
V4
62
V3

V2
57
540°
V5
56

63
57
V4
62
56

SCREW ROTOR MACHINE WITH HOLLOW THREAD ROTOR ENCLOSING A SCREW CAM ROTOR

BACKGROUND OF THE INVENTION

The invention relates to a screw rotor machine for a compressible working medium with a screw cam rotor provided with gudgeons at its ends and a hollow screw thread rotor provided with bearing surfaces and surrounding the screw cam rotor which are rotatably journalled in a housing for rotation around mutually sideways displaced rotation axes which are fixed relative to the housing and coaxial with the gudgeons and the bearing surfaces respectively which rotors during rotation form chambers between their screw cams and screw threads which chambers move from end to end of the rotors while changing their volume.

In screw rotor machines of this and the closely related type where the screw thread rotor is stationary and forms a stator there are a number of suggestions as regards the choice of profile for the cooperating screw cams and screw threads of the rotors. This is shown for example in Swedish patent specification No. 85,331 and U.S. Pat. specifications Nos. 1,892,217 and 2,553,548. Hitherto existing combinations of working profiles with associated rotor journallings and drivings have, however, mostly been complicated, difficult to manufacture, and hardly suitable for effective work at high pressures and rpm.

SUMMARY OF THE INVENTION

The invention has as purpose to combine the simplest possible rotor screw profiles in the above in the introduction mentioned type of screw rotor machines with a simple rotor journalling which can stand high working loads so that the screw cam rotor can work with short sealing lengths and consequently with small leakage losses in the surrounding screw thread rotor and form an effectively rolling bearing journalled drive screw for the screw thread rotor. Through this the machine becomes suitable for qualified applications e.g. as a compressor. This is achieved through the characteristics given in the claims.

BRIEF DESCRIPTION OF THE DRAWINGS

The invention is described more in detail in connection with the accompanying drawings, in which.

DETAILED DESCRIPTION OF THE DRAWINGS

Figure 1:
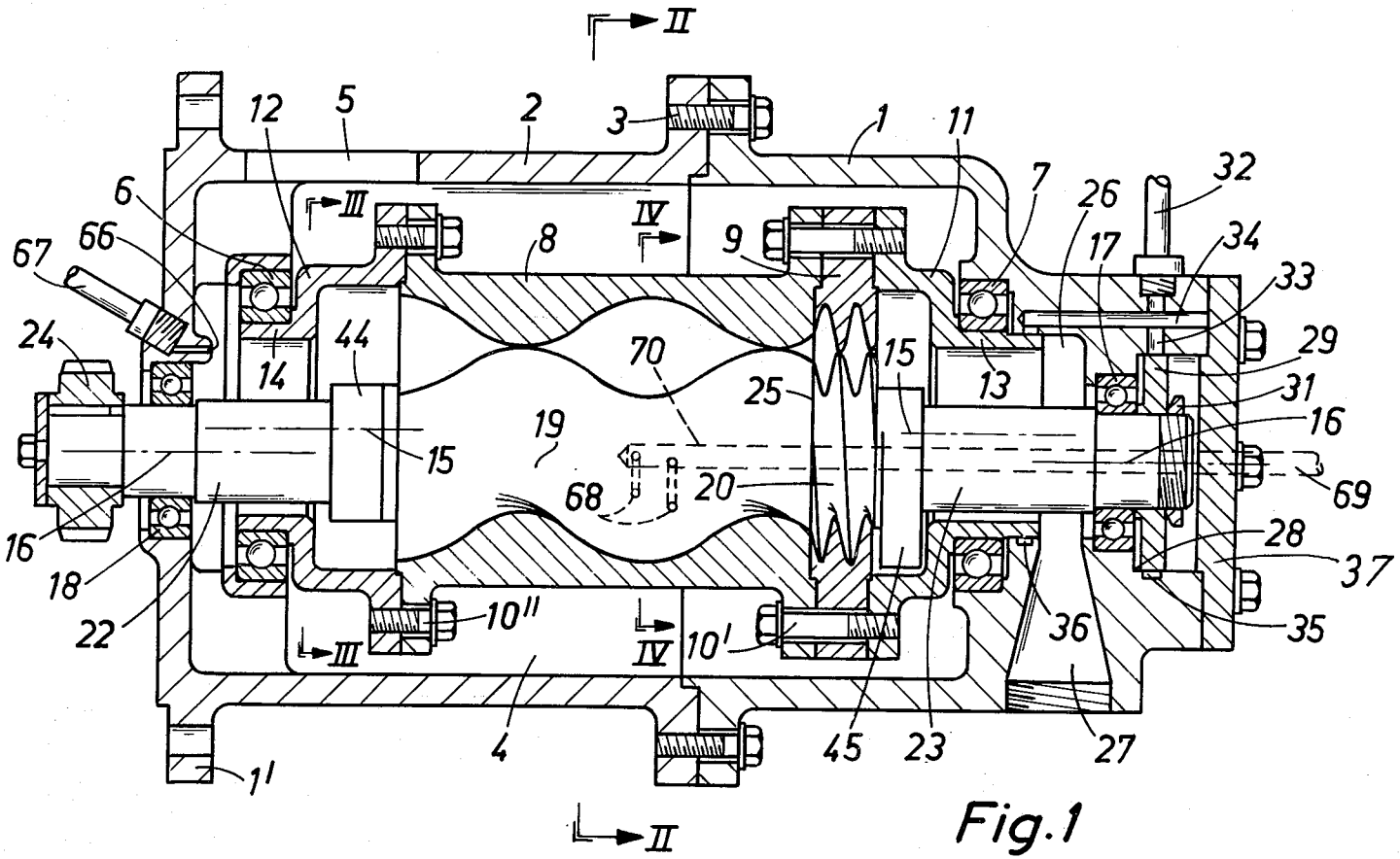
FIG. 1 shows a longitudinal section through a screw rotor machine according to the invention.

In FIGS. 1 – 9 the invention is shown as applied to a screw compressor but the illustrated constructive solution is applicable also to other types of screw rotor machines e.g. to screw motors or screw pumps. The screw compressor shown has a housing 1, 2 which is divided transversely and which at flanges 1[1] is fastened to a not shown compressor aggregate which as regards other components is built up in a conventional way. The housing parts 1 and 2 are kept together by means of screws 3 and enclose a chamber 4 for the compressible working medium, e.g. air. The air enters the housing part 2 via an inlet opening 5 after it has passed a not shown filter. The housing parts 1, 2 carry in the chamber 4 coaxially arranged rolling bearings 6, 7. A gate or screw thread rotor provided with screw threads is divided transversely and comprises two by means of screws 10[1] fixed hollow rotor parts 8, 9 which at their ends are fastened to end parts 11, 12. The end part 11 is fixed by the screws 10[1] and has a tubular neck of shaft 13 with a reduced diameter which is carried by the rolling bearing 7. The end part 12 is fixed by screws 10[11] at the rotor part 8 and has a similarly reduced neck of shaft 14 which is carried by the rolling bearing 6. Through this arrangement the screw thread rotor 8, 9 is rotatably journalled in the chamber 4 for rotation around a fix rotation axis 15.

The rolling bearings 17, 18 are arranged in the respective housing parts 1, 2 and carry rotatably a screw cam rotor formed with two axially aligned cam rotor parts 19, 20 which with gudgeons 22, 23 is introduced into the rolling bearings 17, 18 and rotates around a fix rotation axis 16 which is situated eccentrically at the distance a from and parallel with the rotational axis 15. The screw cam rotor 19, 20 can, if needed, be dynamically balanced by means of eccentric weights 44, 45 which are freely rotatable in hollow spaces in the end parts 11, 12. The screw cam rotor 19, 20 is driven by an external, not shown, motor and gear change over a toothed wheel 24 which outside the housing part 2 is keyed to the gudgeon 22. As will be described more in detail in the following, the screw cam means on the cam rotor parts 19, 20 are during rotation in cooperation with screw threads in the hollow rotor part 8, 9 so that the latter is driven around the axis 15 with a gear change depending on the choosen type of screw cooperation. From the chamber 4 the working medium flows via the neck of shaft 14 and the end part 12 into the screw thread means of the screw thread rotor 8, 9. The screw cam means of the screw cam rotor 19, 20 cooperates with the screw thread means so that the working medium is compressed during its passage through the rotor parts 8 and 9. The compressed working medium enters the end part 11 and continues via the neck of shaft 13 to a pressure chamber 26 in the housing part 1 from which it is taken out under pressure via a high pressure outlet 27.

The pressure chamber 26 is via the rolling bearing 17 open towards a cylindrical guidance 28 which is coaxial with the rotation axis 16 and rotatably carries a balancing piston 29. The piston 29 is by means of a nut 31 together with the inner race of the rolling bearing 17 fastened to the gudgeon 23. Oil under pressure is supplied from a suitable not shown pressure source in the compressor aggregate via a conduit 32 to channels 33, 34 in the housing part 1 of which the channel 33 emerges into a circumferential groove 35 around the piston 29 whereas the channel 34 emerges into a corresponding circumferential groove 36 around the neck of shaft 13 and coaxial with the rotation axis 15. The circumferential grooves 35, 36 form liquid pressure seals by which the pressure chamber 26 is sealed off in relation to the rotating rotor parts. The guidance 28 is covered by a cover 37 and provided with a not shown draining channel outside the piston 29.

Figure 2:
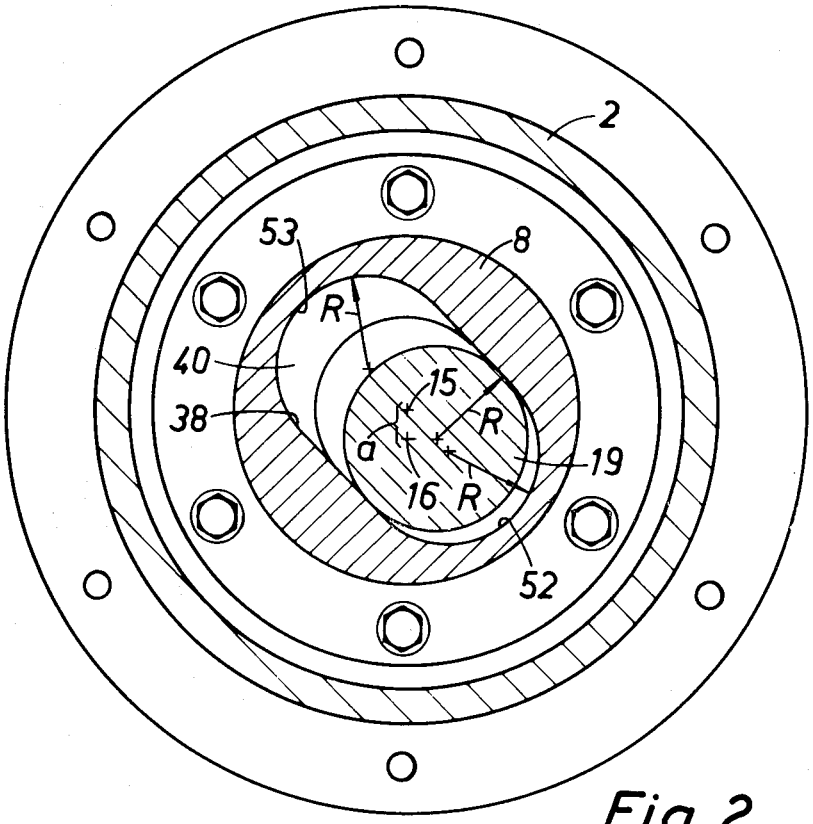
FIG. 2 is a cross section according to line II—II in FIG. 1.
Figure 3:
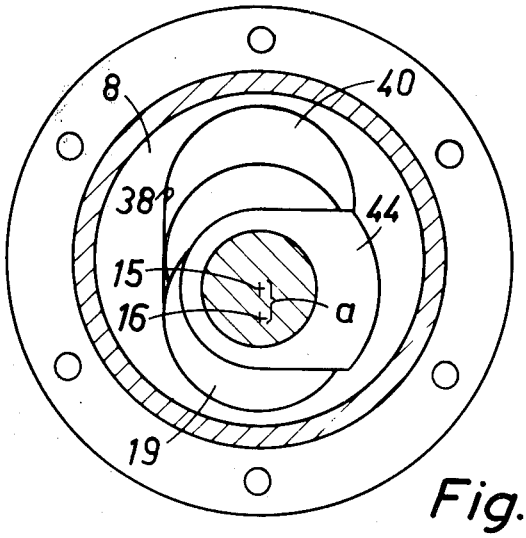
FIG. 3 is a cross section according to line III—III in FIG. 1.
Figure 4A:
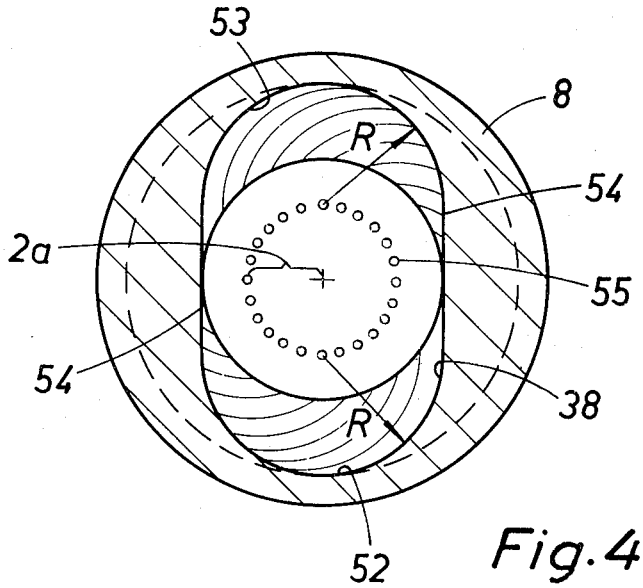
FIG. 4*a* is a cross section according to line IV—IV through the screw thread rotor in FIG. 1.
Figure 4B:
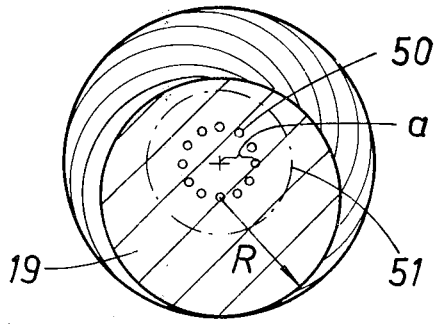
FIG. 4*b* is a corresponding cross section through the screw cam rotor.
Figures 5A, 5B, 5C, 5D, 5E:
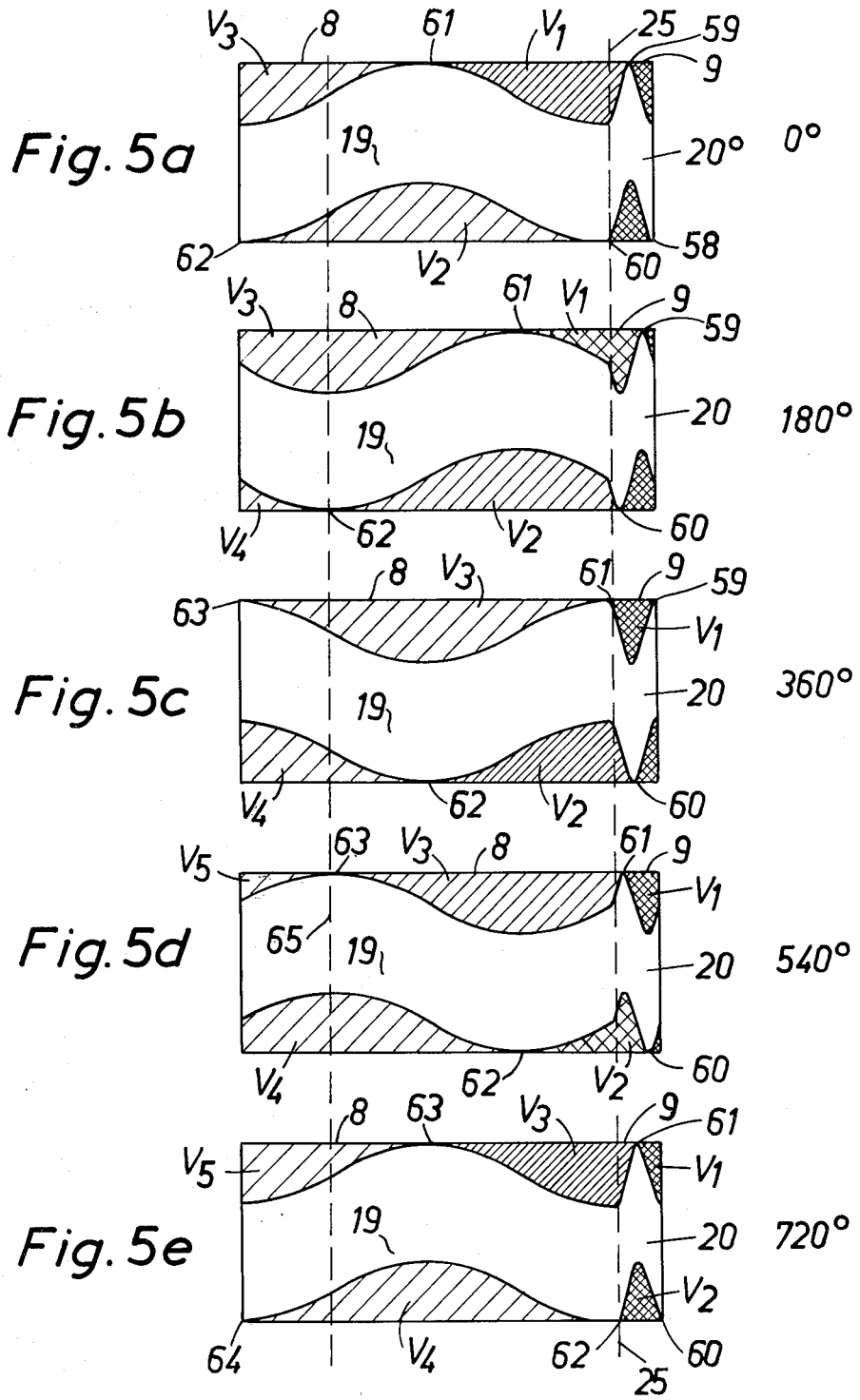
FIGS. 5a – 5e are plane expansions which schematically show in one plane straightened out side views of the helicoidal working chambers which are formed between the rotors during their rotation.

As is shown in FIGS. 2 and 4*b* the screw cam means of the cam rotor part 19 is made as a single-thread-screw which is circularly profiled with the radius R and generated in relation to an inner circular base cylinder 50 which has a diameter equal to double the distance a between the rotation axes 15 and 16. In order to make possible a simple manufacturing with in one piece formed gudgeons 22, 23 and rotor 19 and good jounalling of the latter, through the gudgeons, around the fix rotation axis 15, the radius R is chosen such in relation to the distance a that each cross section of the screw cam rotor 19 will enclose both the inner base cylinder 50 and the maximum cross section of the cylindrical axial extension 51 of the gudgeons 22, 23. These conditions imply that the relation a/R should have a value of between 0.2 and 0.4. It is shown in FIG. 4*b* that the largest possible cross-sectional radius of the gudgeons 22, 23 hereby equals R-a. The cam rotor part 19 is given a wrap angle of approximately 720° and a lead which is defined by the condition that the length of the rotor should be 3–8 times the radius R. The cam rotor part 19 forms a right-hand thread if it is desirable to drive the toothed wheel 24 counterclockwise.

The hollow rotor part 8 of the screw thread rotor 8, 9, FIGS. 2, 4*a*, has two, for glideable cooperation with the cam rotor part 19, identical opposite screw threads 52, 53 formed as half-circles which are joined mutually through straight flanks 54 to a hollow profile enclosed by the contour line 38. Cooperation with the cam rotor part 19 requires that there is a play of about 0.1 mm or less between the hollow profile 38 and the cam rotor part. The screw threads 52, 53 are generated in relation to an outer circular base cylinder 55 with the radius 2*a*. In each cross section of the hollow rotor part 8 the base cylinder 55 is situated inside the hollow profile 38 and its radius is always smaller than R. The direction of the thread of the hollow profile 38 is the same as for the cam rotor part but the wrap angle is half as large i.e. approximately 360°. This means that the hollow rotor part 8 has double the lead of the cam rotor part 19 and when it is driven thereby will rotate with half the rpm of the screw cam rotor 19, 20.

In simple pump or rotary motor applications it is sufficient with the above described simple screw engagement in which the rotors 8, 19 shown in FIG. 1 are used and the rotor parts 9, 20 are excluded. In compressor applications it is, however, desirable to achieve inner compression of the working medium between the rotors before it is supplied to the pressure chamber 26. A continuously decreasing lead would make this possible but results in an undesirable complication of the manufacturing of the rotors.

In order to avoid this the lead of the cam rotor part 19 is suddenly changed without changing the profile at a leap plane 25 which is transverse to the rotors. The cam rotor part 20 has an essentially descreased constant thread lead suitably between 2–10 times smaller lead. The cam rotor part 20 which acts as a high pressure part has a wrap angle of approximately 720°. The hollow rotor part 9 is at the leap plane 25 divided from the hollow rotor part 8 and its screw threads form a continuation of the screw threads 52, 53 but with a decreased constant lead as for the cam rotor part 20 and with a wrap angle of approximately 360°. Through this arrangement the rotor parts 9, 20 will act as gates which axially dam the working medium and which during rotation make inner compression of the working medium between the rotor parts 8 and 19 possible. This is illustrated more in detail in FIGS. 5*a* – 5*e* which for 0°, 180°, 360°, 540° and 720° turning respectively of the screw cam rotor 19, 20 show how the chambers $V_1$–$V_5$ formed between the hollow rotor parts 8, 9 and the cam rotor parts 19, 20 move in the figures from the low pressure end to the right in the direction towards the high pressure end. The hollow rotor parts 8, 9 are in these figures through a thought turning straightened out to a plane expansion and represented by straight lines on both sides of the cam rotor parts 19, 20 which are straightened out in the same plane. Since the high pressure parts 9, 20 of the rotors have essentially smaller leads than the low pressure parts 8, 19 the tangent points shown in FIGS. 5*a* – 5*e* and representing the sealing lines 58 – 64 and which confine the working medium chambers $V_1$ – $V_5$ axially will during rotation move axially slower in the high pressure parts than in the low pressure parts. The transverse sealing lines 59 – 64 will, therefore, be moved together axially from a value in the low pressure part 8 to a minimum value determined by the length of the high pressure rotor part 9 which with the wrap angles in the figures is determining the inner compression of the rotors.

Figures 6A, 6B, 7A, 7B:
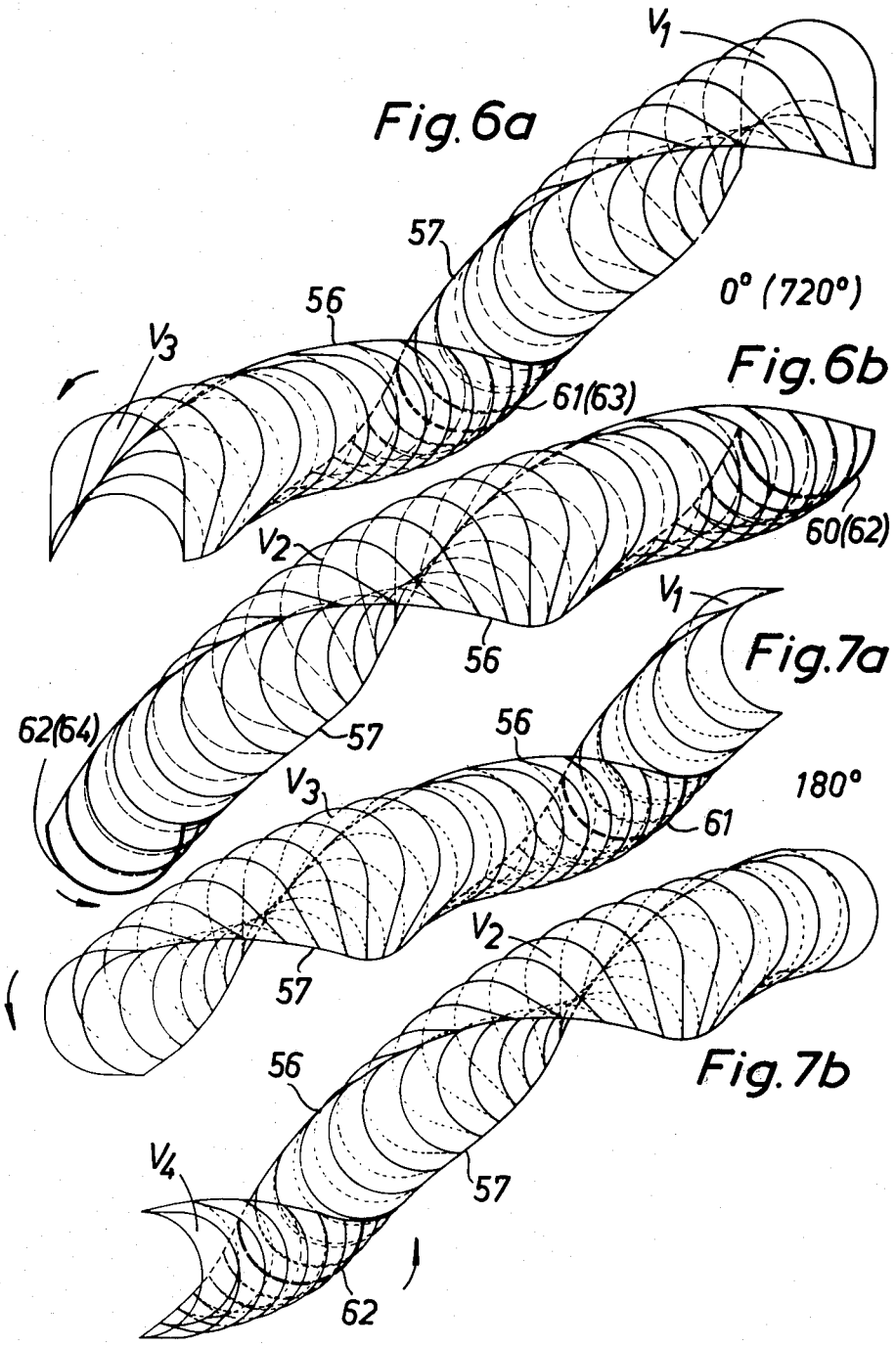
FIGS. 6*a* and 6*b* show the opposite rotor chambers in FIG. 5*a* (FIG. 5*e*) helicoidally in perspective when the rotors are in a position corresponding to FIG. 3.
FIGS. 7*a* and 7*b* show corresponding perspective pictures when the screw cam rotor has turned 180° and the screw thread rotor 90°.
Figures 8A, 8B, 9A, 9B:
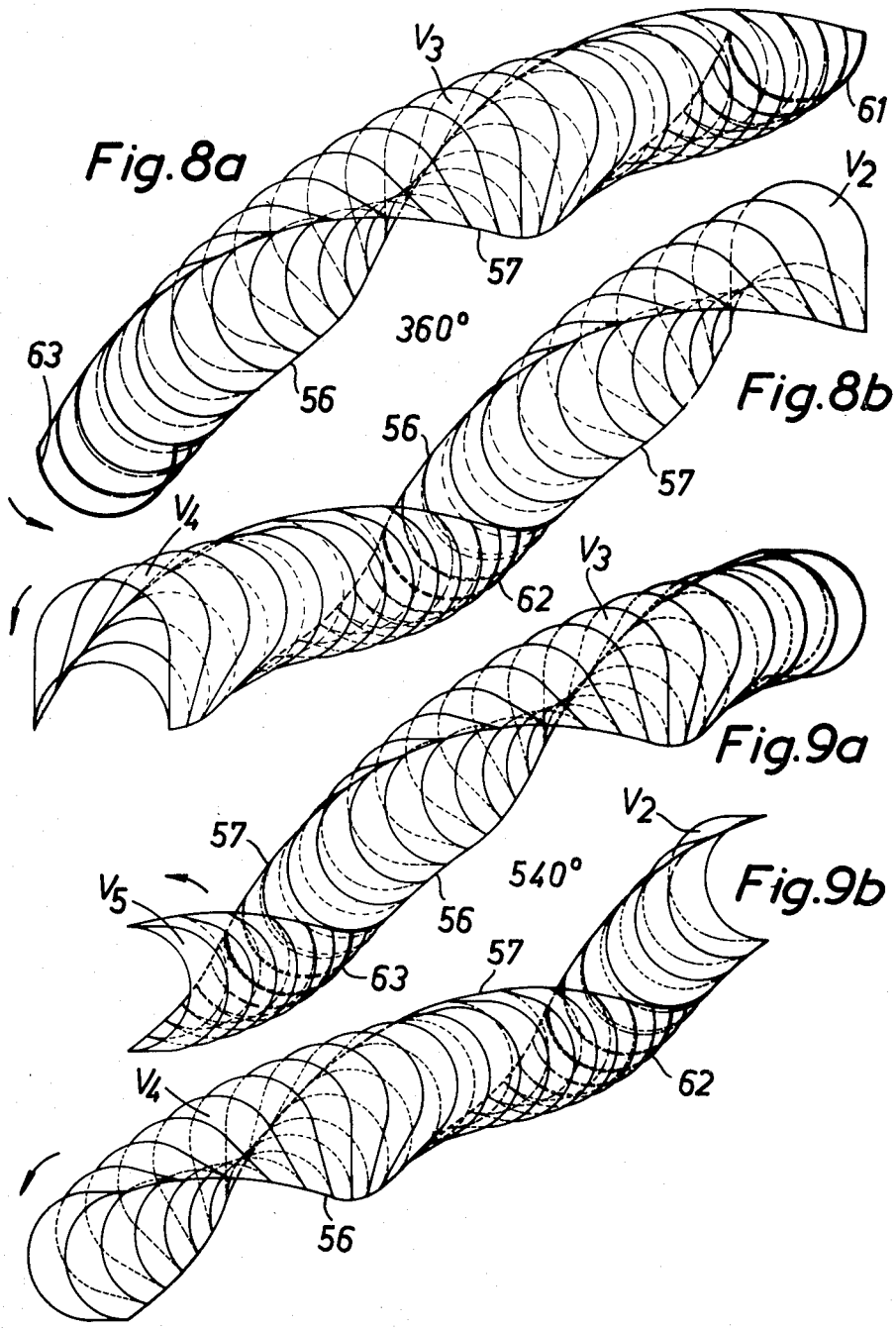
FIGS. 8*a* and 8*b* are corresponding perspective views when the rotors have turned 360° and 180° respectively.
FIGS. 9*a* and 9*b* are corresponding perspective views of the chambers when the rotors have turned 540° and 270° respectively.

In FIGS. 6*a*, 6*b* onwards to 9*a*, 9*b* the real shape and movement within the low pressure part 8, 19 of the rotors of the working medium chambers are illustrated in correspondence to FIGS. 5*a* – 5*e* respectively. The high pressure rotor chambers which are axially strongly compressed but otherwise progress analogously helicoidally have for better clearness been excluded. In FIGS. 6*a*, 6*b* and the subsequent figures the longitudinal sealing lines between the rotors are designated 56 and 57, The axial movement of the transverse sealing lines 60 – 63 towards the high pressure side during the turning of the rotors is clearly shown. The working medium passes through and is compressed in the working chambers $V_1$ – $V_5$ during a pure axial movement, i.e. without rotating around the rotation axes 15, 16, FIG. 1, which because of the analogous build-up of the high pressure parts 9, 20 evidently also is valid for the passage of the working medium through these.

It is clear from FIGS. 5a –5e from the constantly axially moving engagement that the speed of the working medium at the inlet to the low pressure rotor parts 8, 19 is constant. In the same way it is clear that the speed at the outlet from the high pressure parts 9, 20 also is constant but of course essentially lower in proportion to the smaller lead.

Because of the high operational number of revolutions in the present embodiment which for the screw cam rotor can amount to 15,000 rpm and the high flow rate of the working medium following therefrom it is possible to decrease the length of the low pressure parts 8, 19 or their wrap angles so that compression in the working chambers $V_1$ – $V_5$ can start before the following transverse sealing line 62, 63, 64 of the respective chamber has been formed at the inlet of the rotor parts 8, 19, FIGS. 5*a*, 6*b* and 5*c*, 8*a*. This fact is dependent on the lag which arises at the backwards propogation of the compression wave, created at the high pressure parts 9, 20, over the axial length of the low pressure parts and gives a possibility to overload the working medium chambers $V_1 - V_5$ with working medium before the chambers are closed at the low pressure end. This is used by choosing the wrap angles of the low pressure parts of the screw rotor part 19 and the hollow rotor part 8 to approximate 540° and 270° respectively. This means that the length of the screw rotor part 19 and the hollow rotor part 8 are shortened by 25 % with practically unchanged compressor capacity. This shortening of the rotors is illustrated in FIGS. 5a – 5e by the dotted line 65.

In order to improve the driving engagement and the sealing between the screw cam rotor 19, 20 and the screw thread rotor 8, 9 and for cooling the working medium during compression liquid is injected into the working medium, preferably oil in finely divided form. The oil can be injected via a nozzle device 66, carried by the housing part 2, into the neck of shaft 14 so that the interior of the screw thread rotor 8, 9 forms a receiver for the injected liquid. The nozzle device 66 is supplied with oil under pressure via a conduit 67 and is directed towards the interior of the screw thread rotor 8, 9 on that side of the rotation axis 15 which is opposite to the rotation axis 16 i.e. in line with the axial path of movement of the chambers $V_1 - V_5$. While the screw cam rotor rotates a number of rounds the injected liquid cools the working medium in the chambers $V_1 - V_5$ during their entire axial movement. The liquid or oil is carried by the compressed medium via the outlet 27 to a not shown conventional oil separator and oil cooler which is incorporated in the compressor aggregate.

Alternatively the oil can be injected via a nozzle device 68 in form of one or more openings in the screw cam rotor 19, 20 to which the oil is supplied via an oil channel 69 through the cover 37 and one thereto rotatably but sealingly connected central axial rotor boring 70 through the parts 23, 20 and 19 of the screw cam rotor. Since the oil after the oil cooler can have a temperature of up to 50° it is suitable to place the openings 68 in axial positions where a compression temperature between the rotors in the area for beginning compression in the chambers, $V_1 - V_5$ for the working medium which is closely to the oil temperature exists.

What I claim is:

1. In a screw rotor machine for compressible working medium including a screw cam rotor provided with gudgeons, a hollow screw thread rotor provided with bearing surfaces and enclosing the screw cam rotor, the rotors being journalled in a housing for respective rotation around parallel mutually displaced rotation axes, the rotors forming chambers for the working medium between their screw cam and screw threads which chambers move from end to end of the rotors during their rotation while changing their volumes, the improvement enabling high working loads with short sealing lengths and small leakage losses while maintaining simple rotor screw profiles comprising:

a circularly profiled single-thread-screw cam rotor having two parts with different lead angles, the single-thread-screw being generated in relation to an inner base cylinder formed by the centers of the circular rotor cross sections taken along the screw cam rotor axis and having a diameter amounting to two times the distance between the rotation axes, the single-thread-screw cam rotor circular profile enclosing, in each cross section, both the inner base cylinder and cylindrical extensions of the gudgeons the relation between the distance between the rotation axes and the radices of the cam rotor profile amounting to a value between 0.2 and 0.4.

2. A screw rotor machine according to claim 1, wherein the radii of the gudgeons maximally equals the difference between the radius of the cam rotor profile and the distance between the rotation axes.

3. A screw rotor machine according to claim 2, wherein the rotors at a leap plane transverse to the rotors are separated into a low pressure part and a high pressure part whereby the leads of the screw cam and the screw threads in the low pressure part are suddenly changed at the leap plane to a smaller value in the high pressure part and that the screw thread rotor is divided at the leap plane.

4. A screw rotor machine according to claim 3, wherein the screw cam and the screw threads on the high pressure side of the leap plane have wrap angles amounting to approximately 720° and 360° respectively.

5. A screw rotor machine according to claim 4, wherein the screw cam and the screw threads on the low pressure side of the leap plane have wrap angles amounting to approximately 720° and 360° respectively.

6. A screw rotor machine according to claim 4, wherein the screw cam and the screw threads on the low pressure side of the leap plane have wrap angles amounting to approximately 540° and 270° respectively.

7. A screw rotor machine according to claim 1, wherein it is provided with a nozzle device for injecting liquid and that the interior of the screw thread rotor forms a receiver for the injected liquid.

8. A screw rotor machine according to claim 7, wherein the nozzle device is arranged in the housing and directed towards the interior of the screw thread rotor at that side of the rotation axis of the screw thread rotor which is opposite to the rotation axis of the screw cam rotor.

9. A screw rotor machine according to claim 7, wherein the nozzle device is formed in the screw cam rotor as one or more openings placed in the area for beginning compression in the working medium chambers ($V_1 - V_5$).

* * * * *

UNITED STATES PATENT OFFICE

CERTIFICATE OF CORRECTION

Patent No. 3,938,915 Dated February 17, 1976

Inventor(s) Hans Kristoffer Olofsson

It is certified that error appears in the above-identified patent and that said Letters Patent are hereby corrected as shown below:

Column 6, line 15, "radices" should read -- radius --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*